United States Patent [19]

Neal

[11] 4,325,486

[45] Apr. 20, 1982

[54] OVERHEAD GLASS STEMWARE RACK

[76] Inventor: Edwin S. Neal, 101 E. Boulevard, Charlotte, N.C. 28203

[21] Appl. No.: 110,219

[22] Filed: Jan. 7, 1980

[51] Int. Cl.[3] ..... A47B 73/00; A47F 7/28; A47G 29/00

[52] U.S. Cl. ..... 211/71; 211/74; 211/94.5; 211/113; 248/311.3; 248/312

[58] Field of Search ..... 211/71, 74, 113, 118, 211/60 R, 94, 94.5, 86; 248/311.3, 312

[56] References Cited

U.S. PATENT DOCUMENTS

| | | | |
|---|---|---|---|
| 278,161 | 5/1883 | McKee | 248/312 X |
| 1,925,540 | 9/1933 | Neuschotz | 211/86 X |
| 3,022,899 | 2/1962 | Unsworth | 211/71 |
| 4,008,810 | 2/1977 | Merz | 211/71 |
| 4,228,905 | 10/1980 | Cammarota | 211/71 |

*Primary Examiner*—Stephen J. Novosad

*Attorney, Agent, or Firm*—Sixbey, Friedman & Leedom

[57] ABSTRACT

The overhead glass stemware rack includes a plurality of evenly spaced support rails secured to transversely extending stringers. Each support rail includes a central crown which bears against the stringers and a flat extending outwardly below and on either side of the central crown. A reverse curve section then extends between each flat and the peripheral outer edge of the rail. The under face of the rail is decoratively grooved to provide an aesthetic design.

12 Claims, 5 Drawing Figures

OVERHEAD GLASS STEMWARE RACK

TECHNICAL FIELD

The present invention relates generally to racks for holding glasses, and more particularly, to the novel overhead rack for holding glass stemware in an inverted position.

BACKGROUND OF THE INVENTION

Food and beverage serving establishments employ a large number of glasses during a normal business day, and it is necessary to store these glasses in a manner that will render them readily accessible. In the past, overhead racks have been developed for suspending stemware in an inverted position to enhance drying of the glasses when wet and to provide storage in a convenient out-of-the-way location. U.S. Pat. No. 3,022,899 to Alan R. Unsworth discloses a rack of this type formed by a plurality of spaced rails supported by brackets. Racks of this type are quite effective for retaining glass stemware in an inverted position.

Overhead racks for supporting inverted glass stemware have, in the past, incorporated certain characteristics which are somewhat undesirable. First, when such racks are constructed to receive a variety of stemware sizes, the racks have normally been unsightly, and in the alternative, when the racks are made uniform, the use thereof has been extremely limited. Ideally, an overhead rack should provide an aesthetic appearance and contribute to the overall decor of the area within which the rack is placed. Consequently, the rack should be symmetrical with the glass supporting rails thereof evenly spaced. However, in the past evenly spaced glass support rails have limited the use of the racks severely to glasses of only a size which will fit between all of the evenly spaced supporting rails.

Overhead racks capable of supporting glass stemware of widely varying sizes have been constructed with support rails which are unevenly spaced. Thus, as the stemware size increases, the support rails are spaced further and further apart, and such racks are not symmetrical or even in appearance. Thus, aesthetics is sacrificed for practicality.

Aside from aesthetic considerations, overhead stemware racks with unevenly spaced support rails are also difficult to use. It is necessary for a person placing glasses into the rack to carefully select, through trial and error, the support rails which are properly spaced to receive glasses of a certain size. This is not only time consuming, but glasses may easily be improperly placed within the rack and subsequently may fall causing damage or injury.

Finally, inverted stemware racks of the prior art have generally required heavy support brackets which must be secured to a solid overhead support structure. These support brackets are not adjustable, and such overhead racks have not been suitable for use with suspended ceiling structures of the type often found in commercial establishments.

The present invention is directed to overcoming one or more problems related to the above mentioned known prior art.

DISCLOSURE OF THE INVENTION

A primary aspect of the present invention is to provide a novel and improved overhead rack for glass stemware including a plurality of equally spaced support rails which are adapted to receive therebetween stemware of a wide variety of sizes. This is accomplished by forming each rail with a central crown portion which is raised above flats extending laterally on each side of the crown portion. These flats are bounded by stepped portions which terminate along the outer longitudinal edges of the support rail.

Another aspect of the present invention is to provide a novel and improved overhead rack for glass stemware which incorporates a simple support structure readily adaptable for use with suspended ceilings. This support structure includes elongated stringers which extend transverse to a plurality of spaced stemware support rails. These stringers are in turn suspended by vertically extending rods hung from transverse cross bars.

A still further aspect of the present invention is to provide a novel and improved overhead rack for glass stemware which includes a plurality of equally spaced stemware support rails adapted to receive stemware of a wide variety of sizes. These support rails are adapted to be directly supported by a plurality of spaced stringers extending transversely thereto.

The foregoing and other aspects of the invention will become apparent from the following description when considered in conjunction with the accompanying drawings.

BEST MODE FOR CARRYING OUT THE INVENTION

Figure 1:
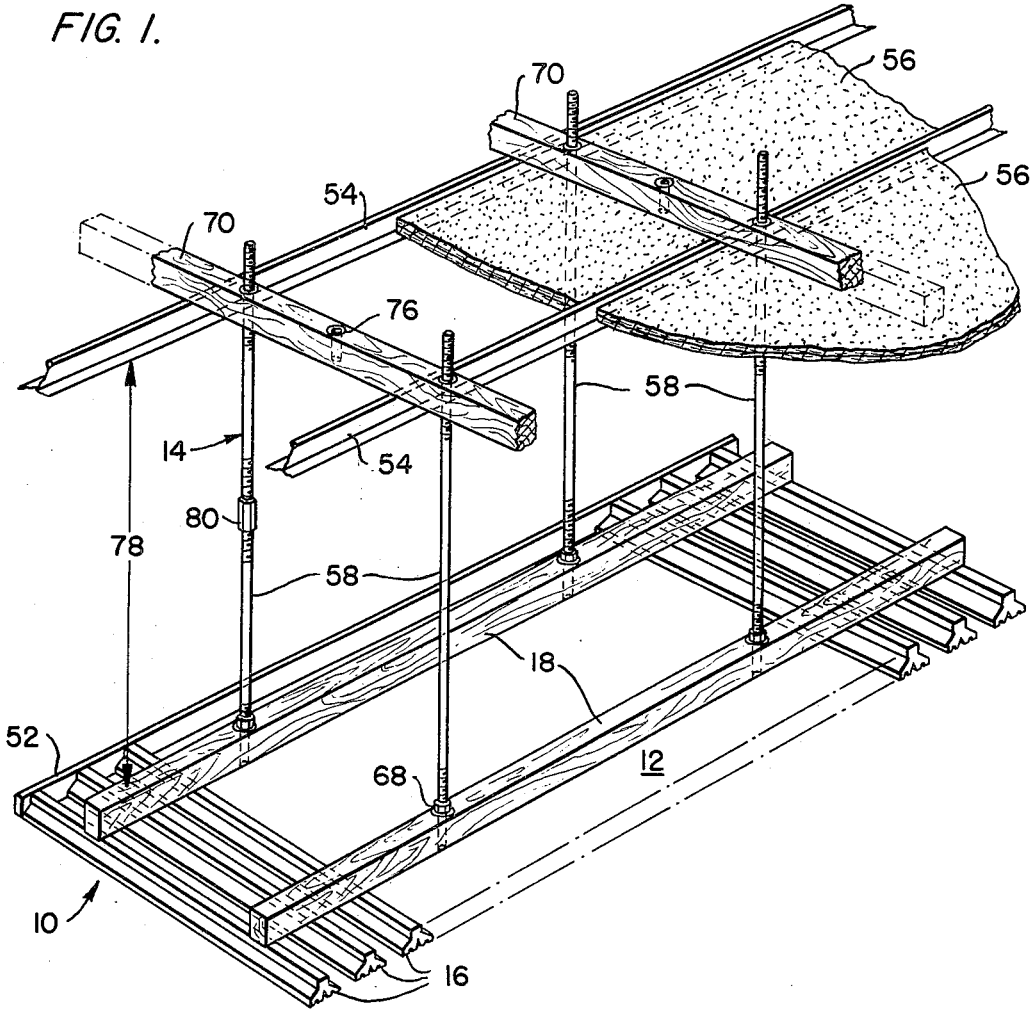
FIG. 1 is a perspective view of the overhead glass stemware rack of the present invention.

Referring now to the drawings, the overhead glass stemware support rack of the present invention illustrated generally at 10 includes a stemware support section 12 which is connected to a suspension section 14. The stemware support section 12 includes a plurality of evenly spaced stemware support rails 16 which extend in parallel relationship. These support rails are directly secured to spaced, parallel stringers 18 which extend substantially perpendicular to the support rails 16.

Each support rail 16 includes a substantially flat bottom surface 20 and a raised crown section 22 which extends along the longitudinal length of the rail on the side thereof opposite to the surface 20. The raised crown section includes a top flat surface 24 which rests against the supporting stringers 18, and the crown section is bounded on either side by flat, laterally extending surfaces or ridges 26 and 28. These flat surfaces may be parallel to the surfaces 20 and 24 or, in the alternative, may incline slightly downwardly from the juncture with the crown 22.

Stepped sections 30 and 32 extend between the flat surfaces 26 and 28 respectively and the longitudinal peripheral edges of the bottom surface 20. The stepped sections 30 and 32 are preferably formed in the shape of a reverse curve. Thus, the stepped section 30 includes a concave curve 34 extending downwardly from the flat 26 and then a convex curve 36 which connects the concave curve portion to the bottom surface 20. The stepped section 32 is similarly formed.

The bottom surface 20 of each stemware support rail 16 includes a centrally positioned, longitudinally extending groove 38 which receives screws or other connecting means (not shown) for connecting a respective support rail to a stringer 18. Other decorative grooves, such as the grooves 40 may be cut in the bottom surface 20 of the support rail to provide a pleasing aesthetic appearance when the rack 10 is suspended above an area.

Figure 2:
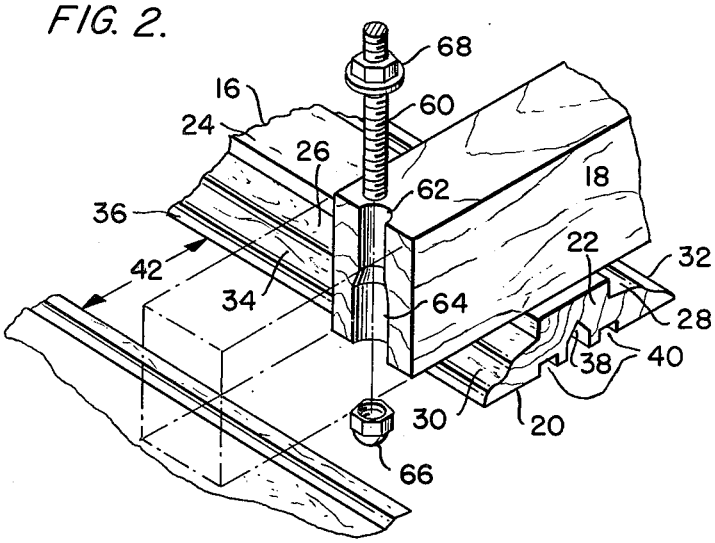
FIG. 2 is a perspective view showing a section of the rack of FIG. 1 with a stemware support rail.
Figure 3:
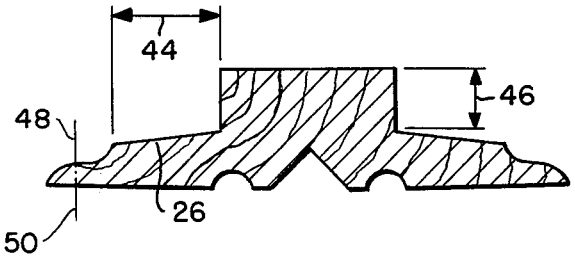
FIG. 3 is a cross sectional view of a stemware support rail.
Figure 4:
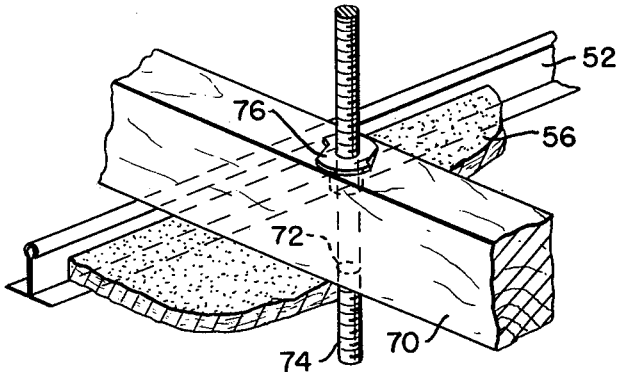
FIG. 4 is a perspective view showing a portion of the overhead support section for the rack of FIG. 1.

The specific construction of the stemware support rail 16 described permits the support rack 10 to function effectively with stemware of most conventional sizes when the support rails are formed and mounted in a manner illustrated in FIGS. 2 and 3. The support rails should be mounted on the stringers 18 so that the support rails are equally spaced throughout the extent of the rack 10. The distance between adjacent support rails must be within the range of from ½ inch to 1¾ inches, and ideally this space should be 1 1/6 inch. The flat surfaces 26 and 28 should be equal in width, and the width of these flats indicated at 44 must be at least ½ inch. Preferably the width of these flat surfaces is approximately ¾ inch.

The distance between the stringer 18 and a flat surface 26 or 28 as shown at 46 must be at least ½ inch, and is preferably at least ⅜ of an inch. Also, the reverse curves 34 and 36 are preferably formed about a ¼ inch radius extending from center points 48 and 50.

The stemware support section 12 is completed by securing the stemware support rails 16 in equally spaced relationship to the stringers 18 by means of screws or other attaching units inserted into the grooves 38. Then, an elongated stop bar 52 is secured along one end of the support rails 16 for the longitudinal extent of the rack. This stop rail provides a stop for glasses which are inserted between two adjacent support rails 16.

The glass stemware support rack 10 of the present invention is particularly adapted for suspension from a suspended ceiling of the type having spaced flanged tracks 54 which support intermediate ceiling panels 56. Suspension section 14 includes at least four hanger rods 58 which are secured at their lower ends to the stringers 18. For example, the lower end of each hanger rod may be threaded at 60 and inserted through an aperture 62 in a stringer 18. The lower end of the aperture 62 may be enlarged at 64 to receive a cap nut 66 which is threaded onto the end of the respective hanger rod 58. A hold-down washer nut 68 may be threaded along the thread 60 and brought into contact with the top of the stringer 18 after the cap nut 66 is in place.

The suspension section 14 also includes spanner or cross bars 70 of sufficient length to extend across the top of the spaced flanged beams 54 above the ceiling panels 56. These cross bars are connected to the upper ends of the hanger rods 58 and suspend the hanger rods from the flanged beams 54. Preferably, each cross bar is predrilled at 72 to receive upper threaded ends 74 of a hanger rod 58, and an embedded nut 76 in the cross bars secures the hanger rod thereto. A plurality of apertures are drilled in the cross bar so that it may be shifted to conform with variable spacing between flanged tracks 54 as shown in FIG. 1.

To adjust the distance 78 between the stemware support section 12 and the flanged tracks 54, the hanger rods 58 may be sectional with coextensive sections being joined by coupling nuts such as the coupling nut 80 in FIG. 1. All four hanger rods 58 may be so constructed, and the coupling nuts 80 may be adjusted both to vary the distance 78 and also to level the stemware support section 12.

Figure 5:
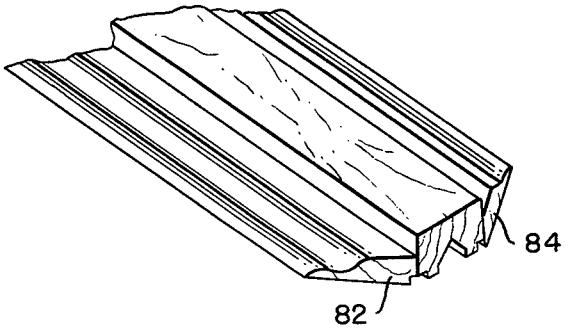
FIG. 5 is a perspective view showing a second embodiment of the stemware support rail of FIG. 1.

In FIG. 5 it will be noted that the ends of the support rail 16 opposite to the stop bar 52 have been beveled inwardly as indicated at 82 and 84. This facilitates insertion of a glass stem between the support rails 16.

The entire rack 10 with the exception of the hanger rods 58 is preferably constructed from wood, but metals, plastics and other suitable materials may be employed.

INDUSTRIAL APPLICABILITY

The overhead glass stemware support rack 10 provides an esthetic suspended structure below a normal ceiling as well as an enhanced support for stemware of widely varying sizes. The support rails 16 are equally spaced but are designed to receive glass bases of varying diameters. For example, the base of a glass may rest upon the flat surfaces 26 and 28 of two adjacent support rails 16 while circular knobs extending out from a glass stem may rest in the reverse curve portions 34 and 36. It is even possible for smaller glass bases to rest upon the upper curve 34 of the reverse curve and to be supported thereby. Since the support rails are equally spaced, a user can insert a glass of almost any size therebetween without locking and hunting for two properly spaced support rails. The complete unit may be adjustably suspended from the flanged tracks 54 for a suspended ceiling by means of the suspension section 14.

What is claimed is:

1. An overhead rack for suspending glass stemware in an inverted position comprising at least two spaced elongated support means, suspension means connected to said support means, and a plurality of spaced, elongated support rails connected to said support means and extending substantially perpendicular thereto, each said support rail including a bottom surface, a central crown section having a top surface spaced from said bottom surface, a flat surface extending laterally from either side of said central crown section below the level of said top surface, and a downwardly extending stepped section connecting the outermost longitudinal edge of each said flat surface with the outermost longitudinal edge of said bottom surface, said downwardly extending stepped sections being in the form of a reverse curve in cross section.

2. The overhead rack of claim 1, wherein a stop bar extends across one end of said spaced support rails for substantially the entire length of said rack and is secured to said support rails.

3. The overhead rack of claim 1, wherein one end of each support rail at one end of said rack is beveled inwardly on either side of the crown section thereof.

4. The overhead rack of claim 1, wherein said suspension means includes at least four elongated suspension units connected at one end to said elongated support means and extending substantially perpendicular thereto, and elongated crossbar means connected to the remaining ends of said elongated suspension units, said elongated crossbar means extending between at least two of said elongated suspension units.

5. The overhead rack of claim 4, wherein at least one of said elongated suspension units is adjustable in length.

6. An overhead rack for suspending glass stemware in an inverted position comprising at least two spaced elongated support means, suspension means connected to said support means, and a plurality of spaced, elongated support rails connected to said support means extending substantially perpendicular thereto, each said support rail including a bottom surface, a central crown section having a top surface spaced from said bottom surface, a flat surface extending laterally from either side of said central crown section below the level of said top surface, and a downwardly extending stepped section connecting the outermost longitudinal edge of each said flat surface with the outermost longitudinal edge of said bottom surface, and a stop bar extending across one end of said spaced support rails for substantially the entire length of said rack and secured to said support rails.

7. The overhead rack of claim 6, wherein said support rails are equally spaced apart for a distance within the range of from ½ to 1 ⅝ inches.

8. The overhead rack of claim 7, wherein the top surface of said crown section is secured against said elongated support means, said crown section being formed to space said top surface at least ¼ inch above said flat surfaces.

9. The overhead rack of claim 8, wherein said downwardly extending step sections are in the form of a reverse curve in cross section, said flat surfaces extending between said crown section and said downwardly extending step sections for a distance of at least ½ inch, and said suspension means includes at least four elongated suspension units connected at one end to said elongated support means and extending susbtantially perpendicular thereto, and elongated crossbar means connected to the remaining ends of said elongated suspension units, said elongated crossbar means extending between at least two of said elongated suspension units.

10. The overhead rack of claim 6, wherein said flat surfaces extend on either side of said crown section for at least ½ inch.

11. An overhead rack for suspending glass stemware in an inverted position comprising at least two spaced elongated support means, suspension means connected to said support means, and a plurality of spaced, elongated support rails connected to said support means and extending substantially perpendicular thereto, each said support rail including a bottom surface, a central crown section having a top surface spaced from said bottom surface, a flat surface extending laterally from either side of said central crown section below the level of said top surface, and a downwardly extending stepped section connecting the outermost longitudinal edge of each said flat surface with the outermost longitudinal edge of each said bottom surface, one end of each support rail at one end of said rack being beveled inwardly on either side of the crown section thereof.

12. An overhead rack for suspending glass stemware in an inverted position comprising at least two spaced elongated support means, suspension means connected to said support means, said suspension means including at least four elongated suspension units connected at one end to said elongated support means and extending substantially perpendicular thereto, an elongated cross bar means connected to the remaining ends of said elongated suspended units, said elongated cross bar means extending between at least two of said elongated suspension units, and a plurality of spaced, elongated support rails connected to said support means and extending substantially perpendicular thereto, each said support rail including a bottom surface, a central crown section having a top surface spaced from said bottom surface, a flat surface extending laterally from either side of said central crown section below the level of said top surface, and a downwardly extending stepped section connecting the outermost longitudinal edge of each said flat surface with the outermost longitudinal edge of said bottom surface.

* * * * *